US008066123B2

(12) United States Patent
Gelardi

(10) Patent No.: US 8,066,123 B2
(45) Date of Patent: Nov. 29, 2011

(54) LOCKABLE AND COMPARTMENTALIZED PACKAGE

(75) Inventor: John A. Gelardi, Midlothian, VA (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 12/765,652

(22) Filed: Apr. 22, 2010

(65) Prior Publication Data

US 2010/0294692 A1 Nov. 25, 2010

Related U.S. Application Data

(63) Continuation of application No. PCT/US2008/080922, filed on Oct. 23, 2008.

(60) Provisional application No. 60/981,910, filed on Oct. 23, 2007.

(51) Int. Cl.
*B65D 85/42* (2006.01)

(52) U.S. Cl. ..... 206/538; 220/345.2; 206/1.5

(58) Field of Classification Search ..... 206/528, 206/531, 532, 534, 536, 1.5, 807, 538, 468; 220/345.1, 345.2
See application file for complete search history.

(56) References Cited

U.S. PATENT DOCUMENTS

| | | | | |
|---|---|---|---|---|
| 194,197 | A | 8/1877 | Villaret | |
| 1,701,565 | A | 2/1929 | Hammett | |
| 1,837,722 | A | 12/1931 | McAtree | |
| 2,090,530 | A | 8/1937 | Guffey et al. | |
| 2,534,100 | A * | 12/1950 | Baumgartner | 220/345.4 |
| 2,769,565 | A | 11/1956 | Sottile | |
| 3,563,412 | A | 2/1971 | James | |
| 3,696,917 | A | 10/1972 | Levi | |
| 3,761,009 | A | 9/1973 | Resenberg | |
| 3,782,584 | A | 1/1974 | Swenson et al. | |
| 3,895,737 | A | 7/1975 | Phillips | |
| 536,923 | A | 3/1976 | Mayled | |
| 4,057,145 | A | 11/1977 | Wray et al. | |
| 4,154,365 | A | 5/1979 | Lorca | |
| 4,284,204 | A | 8/1981 | Carey, Jr. | |
| 4,364,488 | A | 12/1982 | Anjou | |
| 4,437,579 | A | 3/1984 | Obland | |
| 4,561,544 | A | 12/1985 | Reeve | |
| 4,572,376 | A | 2/1986 | Wrennall | |
| 4,611,727 | A | 9/1986 | Graff | |
| 4,705,165 | A | 11/1987 | Thieke | |
| 4,939,860 | A | 7/1990 | Ackeret | |
| 4,967,909 | A | 11/1990 | McKibben | |
| 5,080,222 | A | 1/1992 | McNary | |
| 5,082,137 | A | 1/1992 | Weinstein | |

(Continued)

FOREIGN PATENT DOCUMENTS

| | | | |
|---|---|---|---|
| CH | 180218 | A | 10/1935 |

(Continued)

*Primary Examiner* — Jacob K Ackun
(74) *Attorney, Agent, or Firm* — Womble Carlyle Sandridge & Rice, LLP

(57) ABSTRACT

An exemplary lockable package holds a sliding element within a lockable sleeve. The sleeve comprises a base and a top. The base includes a release button defined by a release surround and a hinge that connects the release button to the base. The release button also includes a free end. Pushing inwardly on the release button urges the free end inwardly to disengage a locked sliding element. The sliding element comprises a sliding base, a sliding top, and an article cover that spans the primary containers. For example, the primary containers are pouches that hold consumable articles, such as vitamins, or personal care articles, such as contact lenses.

22 Claims, 6 Drawing Sheets

U.S. PATENT DOCUMENTS

| | | | | |
|---|---|---|---|---|
| 5,108,006 | A | 4/1992 | Tieke et al. | |
| 5,174,471 | A | 12/1992 | Kozlowski et al. | |
| 5,275,291 | A | 1/1994 | Sledge | |
| 5,657,901 | A | 8/1997 | Farside | |
| 5,782,359 | A | 7/1998 | McAllister et al. | |
| 5,816,441 | A | 10/1998 | Farside | |
| 5,897,025 | A | 4/1999 | Flewitt et al. | |
| 5,909,822 | A | 6/1999 | George et al. | |
| 5,915,560 | A | 6/1999 | George et al. | |
| 6,050,449 | A | 4/2000 | Kanj | |
| 6,131,765 | A | 10/2000 | Barry et al. | |
| 6,155,454 | A | 12/2000 | George et al. | |
| 6,267,265 | B1 | 7/2001 | Issa | |
| 6,382,460 | B1 | 5/2002 | Gonzalez | |
| 6,460,693 | B1 | 10/2002 | Harrold | |
| 6,527,138 | B2 | 3/2003 | Pawlo et al. | |
| 6,564,967 | B1 | 5/2003 | Stringfield et al. | |
| 6,641,031 | B2 | 11/2003 | Evans et al. | |
| 6,758,338 | B2 | 7/2004 | Lien | |
| 6,863,175 | B2 | 3/2005 | Gelardi | |
| 6,913,149 | B2 | 7/2005 | Gelardi et al. | |
| 6,976,576 | B2 | 12/2005 | Intini | |
| 7,159,720 | B2 | 1/2007 | Pearson | |
| 7,216,776 | B2 | 5/2007 | Gelardi | |
| 7,287,666 | B2 | 10/2007 | De Laforcade | |
| 7,320,413 | B2 | 1/2008 | Fusi | |
| 7,353,969 | B2 | 4/2008 | McHutchinson | |
| 7,533,785 | B2 | 5/2009 | Smith | |
| 7,565,969 | B2 | 7/2009 | He | |
| 7,584,843 | B2 | 9/2009 | Kutsch et al. | |
| 7,588,149 | B2 * | 9/2009 | Gelardi | 206/531 |
| 7,712,630 | B2 | 5/2010 | He | |
| 7,740,132 | B2 | 6/2010 | Oono et al. | |
| 2002/0175195 | A1 | 11/2002 | Cole | |
| 2003/0106900 | A1 | 6/2003 | Storz | |
| 2004/0074917 | A1 | 4/2004 | McHutchinson | |
| 2004/0217024 | A1 | 11/2004 | Arnarp et al. | |
| 2005/0011773 | A1 | 1/2005 | Intini | |
| 2005/0173272 | A1 | 8/2005 | Lemmons, IV | |
| 2005/0183981 | A1 * | 8/2005 | Gelardi | 206/531 |
| 2005/0205598 | A1 | 9/2005 | Gelardi | |
| 2006/0006091 | A1 * | 1/2006 | Maietta | 206/539 |
| 2006/0060480 | A1 | 3/2006 | Budd | |
| 2006/0118589 | A1 | 6/2006 | Arnarp et al. | |
| 2006/0124658 | A1 | 6/2006 | Coe et al. | |
| 2006/0243611 | A1 | 11/2006 | Wu | |
| 2007/0068960 | A1 | 3/2007 | Valentine et al. | |
| 2007/0102318 | A1 | 5/2007 | Gelardi et al. | |
| 2007/0163911 | A1 | 7/2007 | Gelardi | |
| 2007/0246382 | A1 | 10/2007 | He | |
| 2007/0246383 | A1 | 10/2007 | He | |
| 2007/0277299 | A1 | 12/2007 | Kroon | |
| 2008/0029110 | A1 | 2/2008 | Dube et al. | |
| 2008/0029116 | A1 | 2/2008 | Robinson et al. | |
| 2008/0142535 | A1 | 6/2008 | Adler et al. | |
| 2008/0290110 | A1 | 11/2008 | Gelardi et al. | |
| 2009/0200332 | A1 | 8/2009 | Intini | |
| 2009/0223989 | A1 | 9/2009 | Gelardi | |
| 2009/0266837 | A1 | 10/2009 | Gelardi et al. | |
| 2010/0018882 | A1 | 1/2010 | St. Charles | |
| 2010/0018883 | A1 | 1/2010 | Patel | |
| 2010/0084424 | A1 | 4/2010 | Gelardi | |
| 2010/0133140 | A1 | 6/2010 | Bailey et al. | |

FOREIGN PATENT DOCUMENTS

| | | | |
|---|---|---|---|
| GB | 2 042 476 | A | 9/1980 |
| WO | WO 99/48391 | A1 | 9/1999 |
| WO | WO 2004/035404 | A1 | 4/2004 |
| WO | WO 2004/037657 | | 5/2004 |
| WO | WO 2005/016036 | A1 | 2/2005 |
| WO | WO 2005/028316 | | 3/2005 |
| WO | WO 2005/030606 | | 4/2005 |
| WO | WO 2005/035390 | A1 | 4/2005 |
| WO | WO 2007/017761 | A2 | 2/2007 |
| WO | WO 2007/067953 | A2 | 6/2007 |
| WO | WO 2007/070867 | | 6/2007 |
| WO | WO 2008/070032 | A2 | 6/2008 |
| WO | WO 2009/055547 | | 4/2009 |

* cited by examiner

LOCKABLE AND COMPARTMENTALIZED PACKAGE

CROSS-REFERENCE TO RELATED APPLICATIONS

This application is a continuation of International Application No. PCT/US2008/080922, filed Oct. 23, 2008; which claims priority to U.S. Provisional Application No. 60/981,910, filed Oct. 23, 2007, which are hereby incorporated by reference in their entirety.

FIELD OF THE INVENTION

The present invention relates generally to a lockable case for storing and dispensing articles. More specifically, the present invention is directed to a package including a locking mechanism, a releasing mechanism, and a compartmentalized sliding tray that holds articles and/or primary containers that hold articles.

BACKGROUND

Child-resistant or lockable containers, wherein multiple movements are required to open the container, have many uses. One use for a lockable container is to inhibit access to articles such as medicine and medicaments in the form of pills and tablets, which if consumed by an unintended person could be fatal. For example, locking caps on medicine bottles are well known. The typical locking cap mechanism requires a coordinated alignment and tipping, or axial pressure, or inward radial squeezing while turning the cap, to remove it from the bottle and in order to access the articles therein.

By way of another example, articles may be packaged in a primary container and the primary containers grouped and packaged in a secondary container, such as a paperboard box. Examples of primary containers include chips, satchels, pouches, pillows, vials, blister packs, and the like. When a typical paperboard box holding one or more primary containers is opened, all of the articles are immediately available. Children who can open such secondary containers now may have access to a dangerous quantity of articles not intended for their consumption.

Against the present state of the art, the Applicant seeks to create a need and market for containers that can store and orderly dispense articles and/or primary containers held in compartments. In addition, the Applicant seeks to create a need and market for containers with one or more compartments located on a sliding element, such as a tray. The Applicant also seeks to create a need and market for a container having a slidable, compartmentalized tray with child-resistant features that require coordinated motions to unlock. Further, the Applicant seeks to create a need and market for a child-resistant secondary package having a slidable, compartmentalized tray, which is inexpensive to manufacture and re-useable.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

It is contemplated that the present invention is not limited to the pharmaceutical and personal healthcare related articles referenced with the illustrated embodiment, but is applicable to any small, delicate, sensitive, or portable article. Examples of such articles include all manner of consumable products such as candy, food, vitamins, tobacco, and the like; all manner of personal care products such as contact lens, birth control devices, smoking cessation patches, hearing aid batteries, and the like; and any item that can fit within a portable container. Further, the present invention is not limited to the slidable tray with compartments referenced with the illustrated embodiments, but is applicable to any slidable element, card, rack, support, holder, shelf, drawer, vessel, and the like to which an article of any sort may be held, stored, attached, secured or otherwise associated with the article.

Figure 5A:
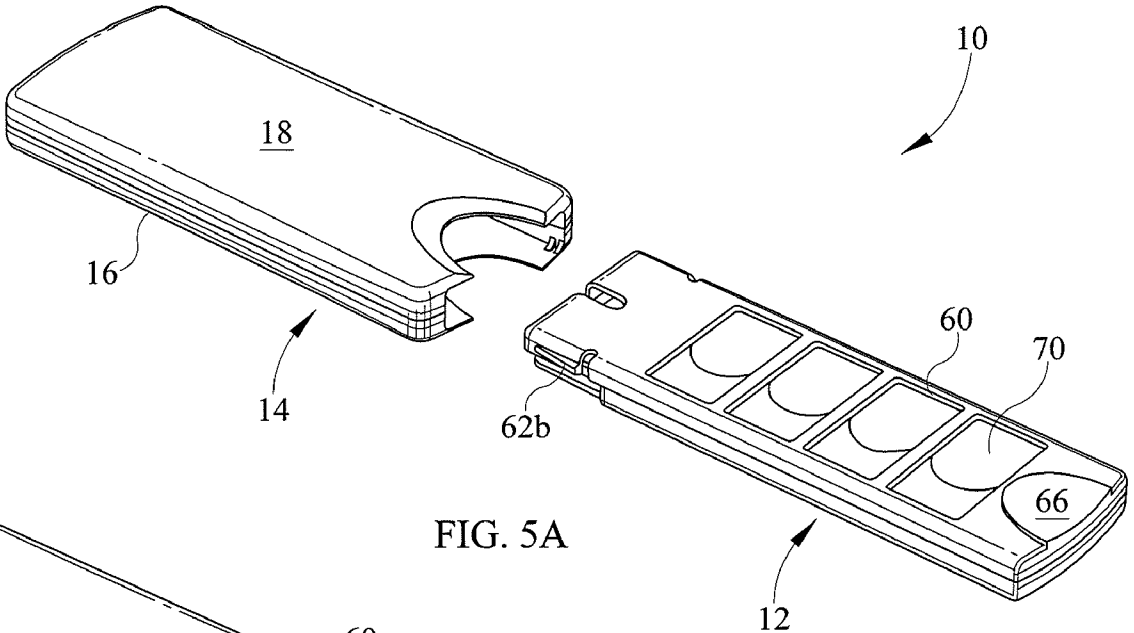
FIGS. 5A and 5B show the further assembly of the package of FIG. 1.
Figure 5B:
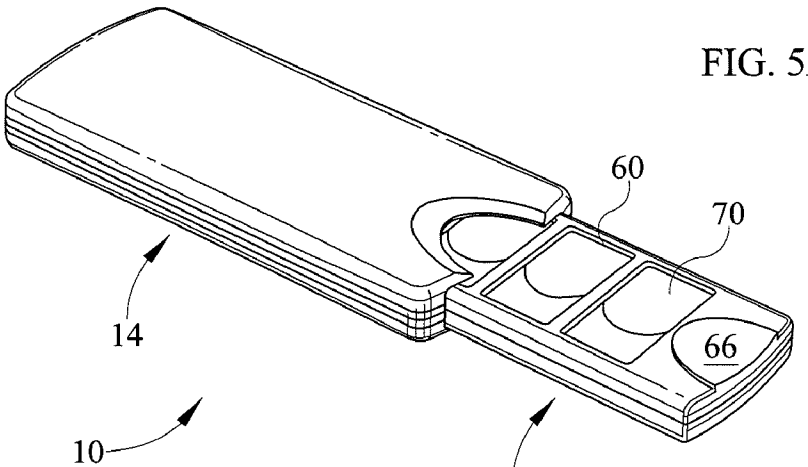

Referring now to the drawings, wherein like numerals represent like features throughout, there is illustrated an embodiment of the present invention. Turning first, momentarily, to FIGS. 5A and 5B, there is shown two views of an exemplary lockable package 10. As illustrated, the lockable package 10 holds a sliding element 12 within a lockable sleeve 14.

Figure 1:
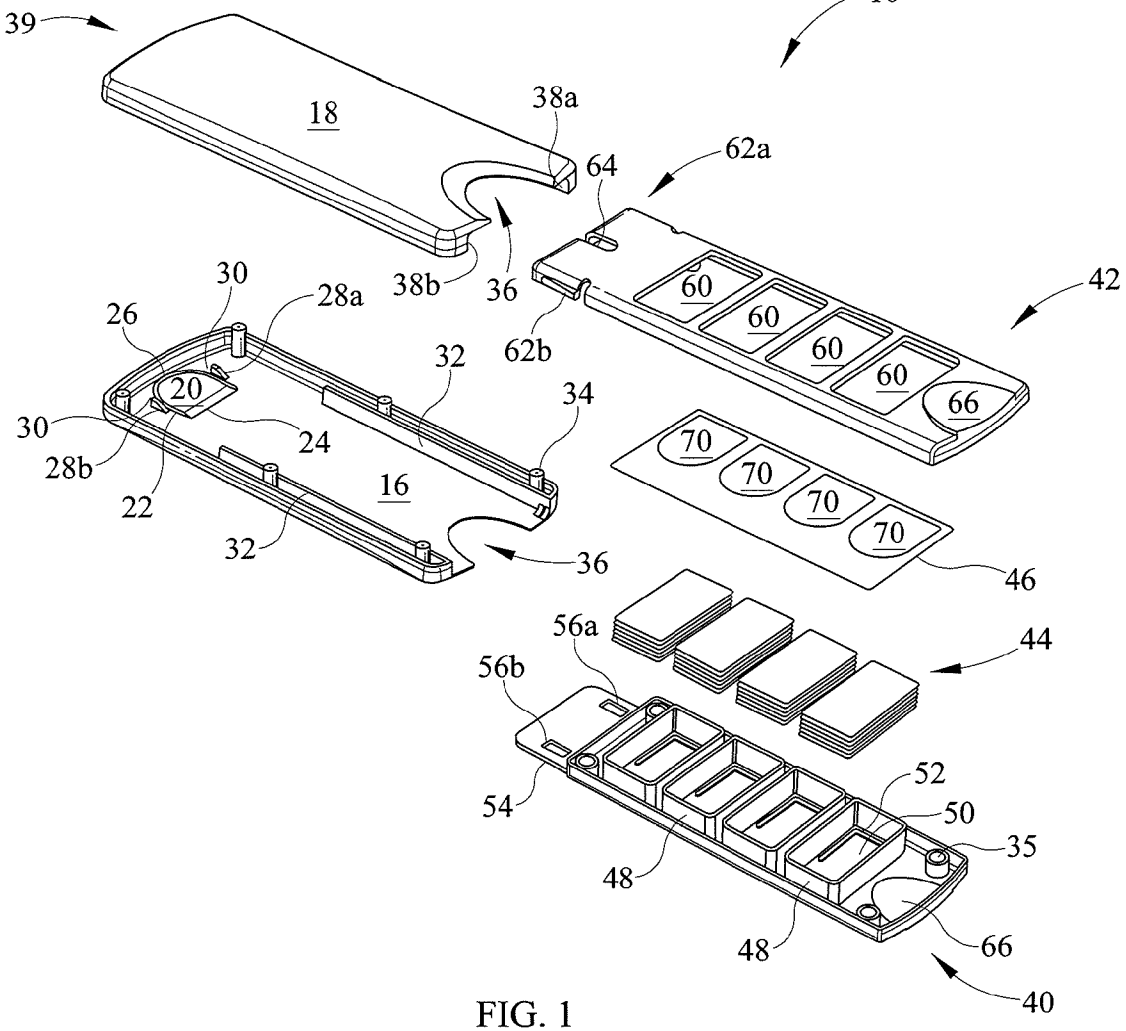
FIG. 1 is an exploded view of an exemplary lockable package, according to the present invention.
Figure 2:
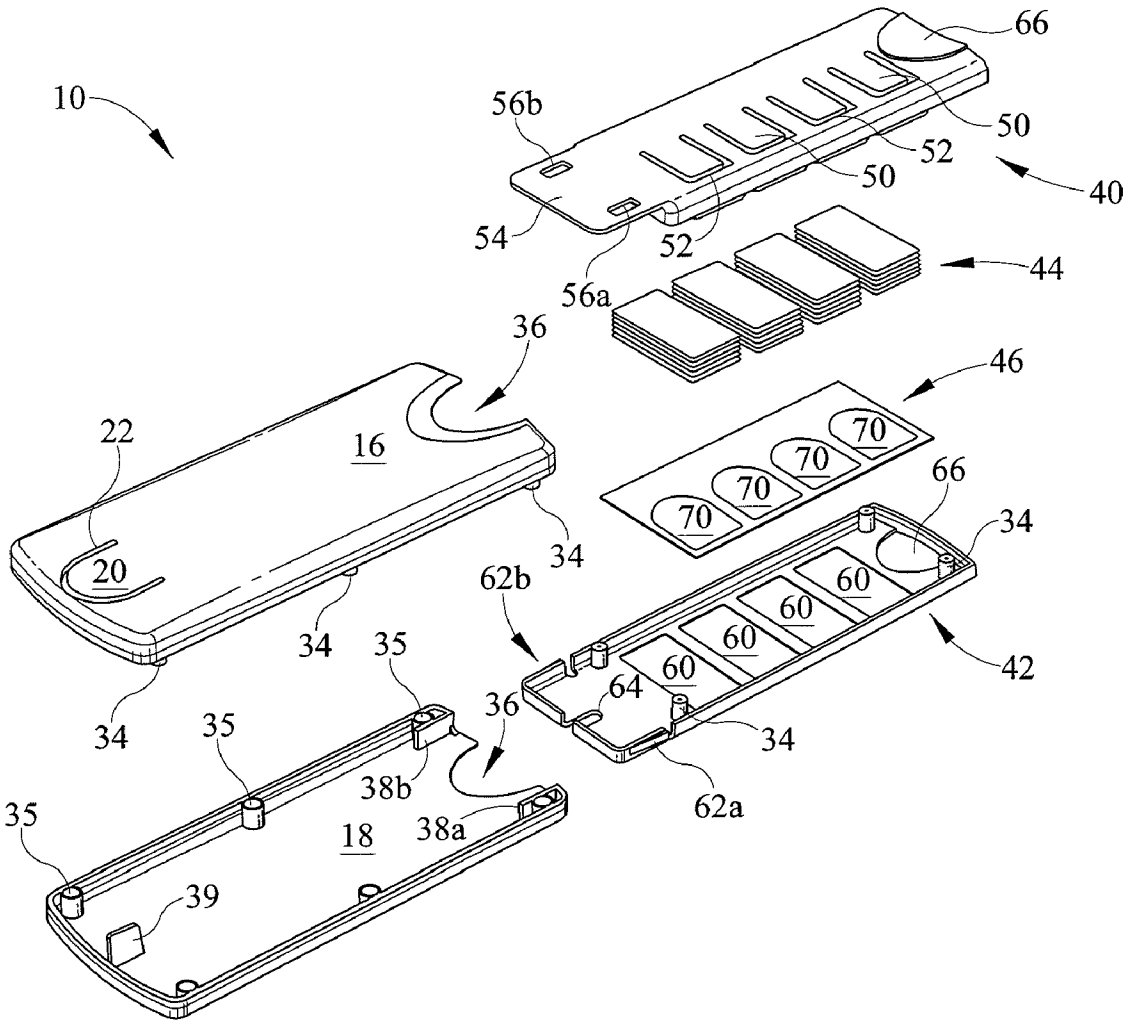
FIG. 2 is an alternative exploded view of the lockable package of FIG. 1.

Turning now to FIGS. 1 and 2, the sleeve 14 comprises a base 16 and a top 18. The base 16 includes a release button 20 defined by a release surround 22 and a hinge 24 that connects the release button 20 to the base 16. The release button 20 also includes a free end 26. Pushing inwardly on the release button 20 urges the free end 26 inwardly to disengage a locked sliding element 12, as explained below.

The base 16 further includes elements that form an internal locking mechanism: a plurality of locking posts 28*a*, 28*b*, each with a respective engaging edge 30, are located proximate to the release button 20. In alternative embodiments one locking post is provided, in other embodiments additional locking posts 28*x* are provided. The sleeve base 16 further includes guide rails 32. Associated with the sleeve base 16 and top 18 are means for attaching 34, 35, and an optional recess 36, as explained below. The sleeve top 18 further includes stop ribs 38*a*, 38*b* and a release button stop 39.

The illustrated sliding element 12 comprises a sliding base 40, a sliding top 42, and an article cover 46 that spans the primary containers 44. Here, for purpose of illustration and not limitation, the primary containers 44 are shown as pouches that hold consumable articles such as vitamins, or personal care articles such as contact lens. Alternative or additional primary containers 44 are contemplated, however, including chips, satchels, pouches, pillows, vials, blister packs, and the like.

The exemplary sliding base 40 includes at least one compartment or article bin 48 for storing at least one primary container 44. In alternative embodiments, articles are placed directly in the article bin 48 without regard to a primary container 44. To facilitate removal of the primary container 44 or article from the article bin 48, there is provided a means for biasing. The illustrated means for biasing is a lever 50 defined by a lever surround 52. Inwardly pushing on the lever 50 urges the primary container 44 or article out of the bin 48, as described below. Alternative means for biasing include leaf springs, flexible ribs, wheels, and similar configurations located within or proximate to the article bin 48, which exert a compressive force on the primary containers 44.

The illustrated sliding element 40 further includes a locking tab 54 having a number of locking apertures 56*a*, 56*b* configured to releaseably engage with a respective number of locking post 28*a*, 28*b*. Here, the locking apertures 56*a*, 56*b* are configured to cooperatively engage the sliding base 40 to the sleeve base 16 to prevent movement or lateral translation of the sliding element 12 out of the sleeve 14 until the sliding element 12 is intentionally released by pressing or otherwise properly manipulating the release button 20.

The sliding top 42 comprises a number of access windows 60 corresponding to a respective number of article bins 48, and engaging stops 62*a*, 62*b* corresponding to a respective number of stop ribs 38*a*, 38*b*, a receiving notch 64, and a relief 66. The illustrated sliding base 40 also includes a relief 66.

A number of gates 70, corresponding to a respective number of access windows 60, are located on the article cover 46. The assembly and operation of the elements listed above to form the lockable package 10, best shown in FIGS. 5 and 6, will now be described.

Figure 3:
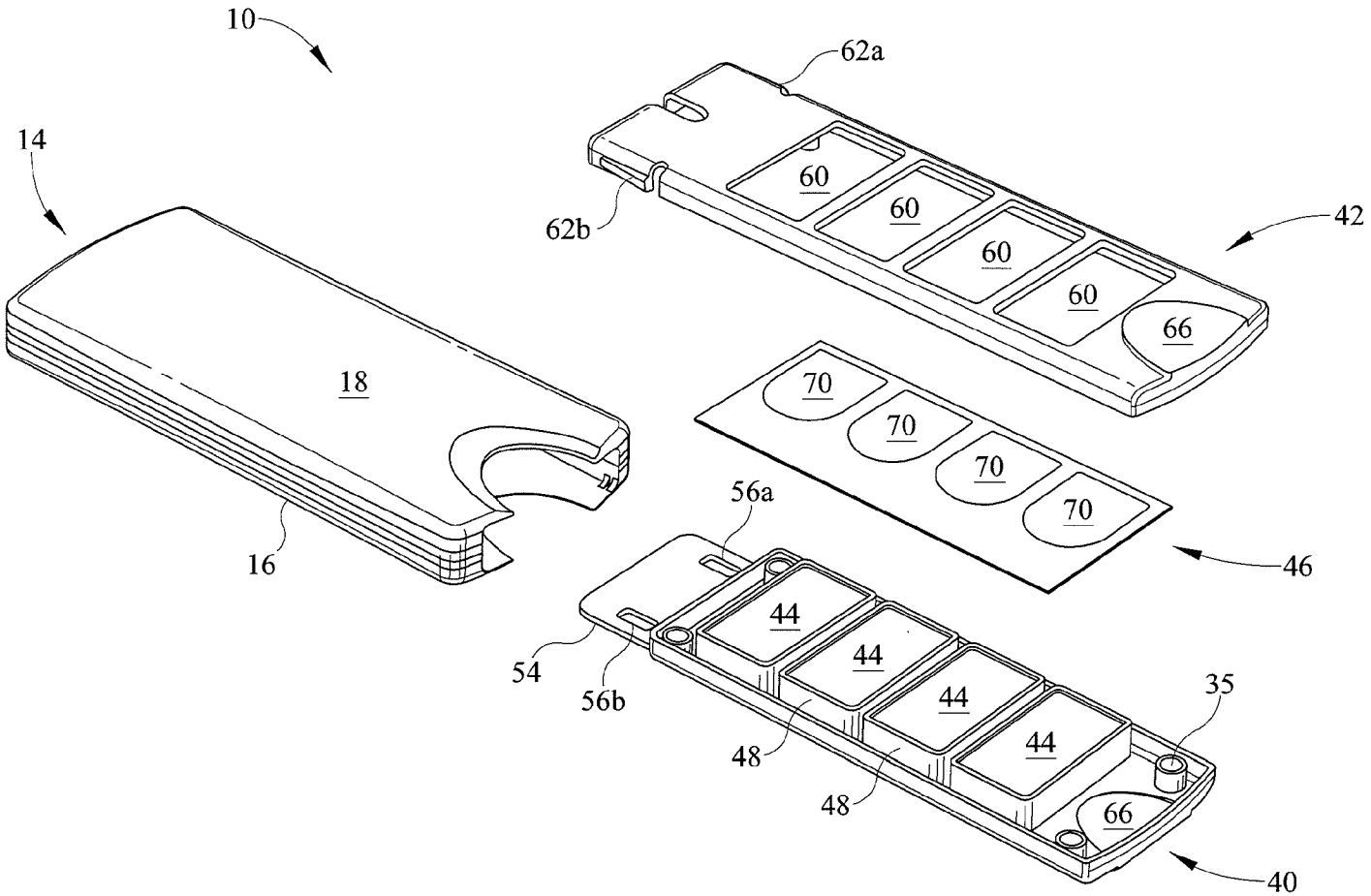
FIG. 3 is an exploded view of the partially assembled package of FIG. 1.
Figure 4:
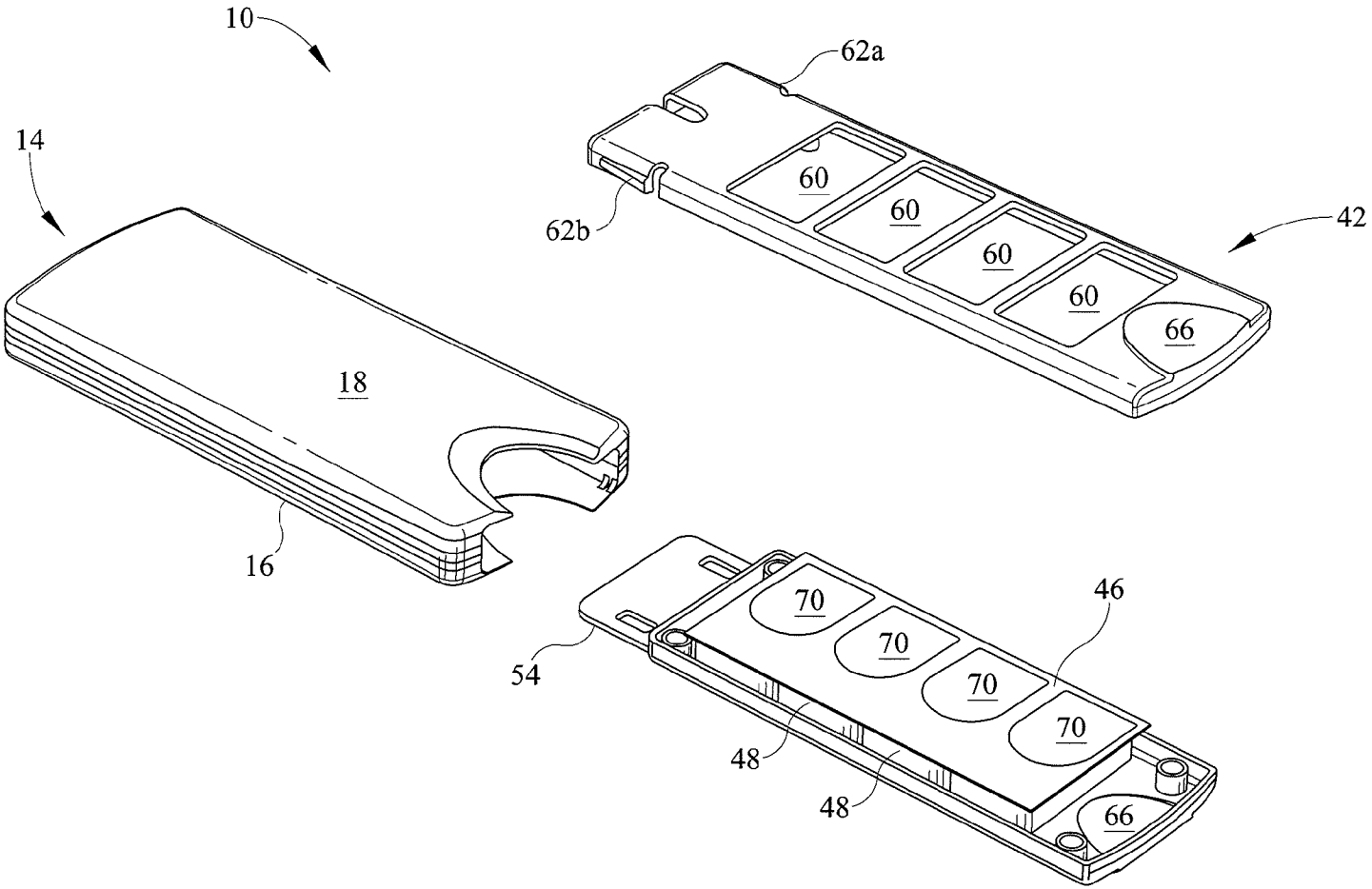
FIG. 4 is an exploded view of the further assembled package of FIG. 1.

An exemplary method for assembling the sleeve 14 is best shown in FIGS. 1-3. There, the sleeve base 16 and top 18 can be permanently or temporarily attached by pins 34 that matingly engage cylinders 35. In this manner the base 16 and top can be snapped together. Further, the sleeve 14 can be permanently welded, glued, or otherwise connected if so desired. Upon connecting the base 16 to the top 18 a lockable sleeve 14, with an open end and defining a void, is assembled as best shown in FIGS. 3-5.

In a similar manner, an exemplary method for assembling the sliding element 12 is shown in FIGS. 1-5. There, the primary containers 44 are placed in respective article bins 48 and the article cover 46 is positioned over the articles bins 48, such that each gate 70 correspondingly aligns with a respective article bin 48. The sliding top 42 is then positioned over the article cover 46, such that each access window 60 correspondingly aligns with a respective gate 70. With the sliding base 40, article cover 46, and sliding top 42 aligned, the elements can be permanently or temporarily attached by pins 34 that matingly engage cylinders 35. In this manner the sliding base 40 and sliding top 42 can be snapped together. Further, the sliding element 12 can be permanently welded, glued, or otherwise connected if so desired. Upon connecting the sliding base 40 to the top 42, a sliding element 12 is assembled, as best shown in FIGS. 5A and 5B.

As best shown in FIGS. 5 and 6, an assembled sliding element 12 is inserted into an assembled sleeve 14 to form a lockable package 10. With a view toward FIG. 1, in inserting the sliding element 12 into the open end of the sleeve 14, the guide rails 32 laterally direct the locking tab 54 and sliding element 12 into the sleeve 14 interior. Fully inserting the sliding element 12 causes the locking tab 54 to ride up and over the locking tabs 28*a*, 28*b* until they breach and engage the locking apertures 56*a*, 56*b* along the respective engaging edge 30. Simultaneously, the receiving notch 64 permits the release button stop 39 to not interfere with the full insertion of the sliding element 12. With the locking tabs 28*a*, 28*b* and locking apertures 56*a*, 56*b* engaged, the sliding element 12 is now fully inserted and releaseably locked within the sleeve 14.

To release a locked sliding element 12 from the protective sleeve 14, the release button 20 is pressed inwardly, to lift the locking tab 54, until the locking apertures 56*a*, 56*b* are lifted over the locking posts 28*a*, 28*b*. Simultaneously, the opposite or free end of the sliding element 12 is grasped at the paired relief 66 and pulled to reveal at least an article bin 48. The illustrated sliding element 12 can continue to be extracted from the sleeve 14, but will be stopped from being fully extracted when the engaging stops 62*a*, 62*b* abut the respective stop ribs 38*a*, 38*b*.

The release button stop 39 prevents the release button 20 from being pushed too far inwardly and perhaps damaged. The height and position of the release button stop 39 can also influence the ease or difficulty of manipulating the release button 20 and the engagement of the locking apertures 56*a*, 56*b* with the locking posts 28*a*, 28*b*. In addition, the respective locations of the engaging stops 62*a*, 62*b* and stop ribs 38*a*, 38*b* are a design choice.

Figure 6A:
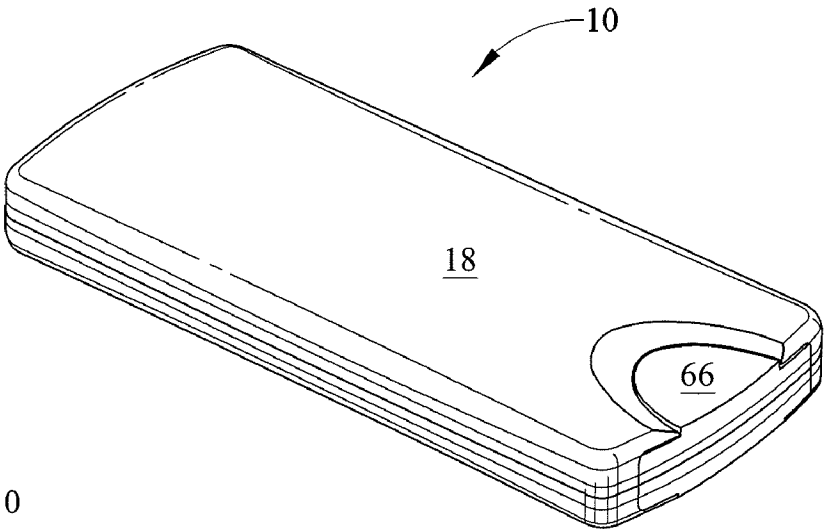
FIGS. 6A and 6B show alternative views of the fully assembled package of FIG. 1.
Figure 6B:
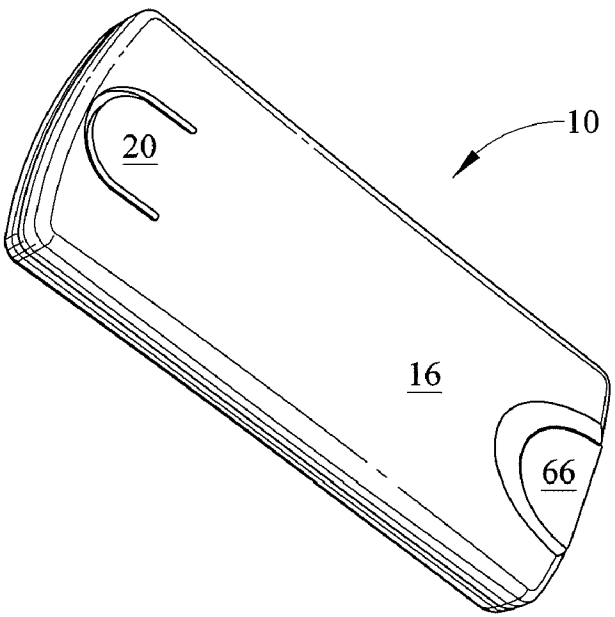

As best shown in FIGS. 5A and 5B, to remove a primary container 44 from the lockable package 10, the sliding element 12 is extracted until a desired article bin 48 is exposed, or until the stopping elements 38*a*, 62*a*, 38*b*, 62*b* abut. A gate 70, which in the illustrated embodiment is constructed of paperboard, is lifted or torn from the article cover 46 to expose at least a portion of the primary container 44. Pushing inwardly on the lever 50 of the selected article bin 48 urges the primary container 44 or article through the respective gate 70. After removing one or more primary containers 44 or articles, the sliding element 12 can be relocked by fully inserting it within the sleeve 14, as best shown in FIGS. 6A and 6B.

Alternative embodiments include alternative gates 70. For example, if lesser child-resistance is desired of a particular package 10, then the gates 70 can be configured to be easy to breach. If greater child-resistance is desired of a particular package, however, then the gates 70 can be configured to be much more difficult to breach. Further, the function of the article cover 46 can be combined with the function of the sliding top 42. In addition, alternative article covers 46, as well as the package 10 as a whole, can be made of plastic, cardboard, paperboard, foil, combinations thereof, and the like.

For the purposes of teaching and not limitation, various elements are described herein with directional or positional adjectives, such as "top" and "base", but it is contemplated that the position or location of many elements can be switched or reversed. For example, the release button 20 and locking posts 28*a*, 28*b* can be located on the sleeve top 18, the release button stop 39 can be positioned on the sleeve base 16, the locking apertures 56*a*, 56*b* can be located on the sliding top 42, and the sliding element 12 will still be releaseably locked within the lockable sleeve 14. Further, the guide rails 32 can be associated with the sleeve top 18, and the stop ribs 38*a*, 38*b* can be associated with the sleeve base 16 while the engaging stops can be associated with the sliding base 40.

The law does not require and it is economically prohibitive to illustrate and teach every possible embodiment of the present claims. Hence, the above-described embodiments are merely exemplary illustrations of implementations set forth for a clear understanding of the principles of the invention.

Variations, modifications, and combinations may be made to the above-described embodiments without departing from the scope of the claims. All such variations, modifications, and combinations are included herein by the scope of this disclosure and the following claims.

What is claimed:

1. A lockable package for storing and dispensing articles, comprising:

an outer sleeve having an interior void and an open end, wherein the outer sleeve comprises at least one locking post and a release button proximate to the locking post;

a sliding tray received within the interior void of the outer sleeve and having a pair of opposing reliefs positioned to abut the outer sleeve at the open end thereof when the package is in a locked position, the sliding tray defining at least one compartment accessible through an access window and configured to receive at least one article, the sliding tray further comprising a locking tab having at least one locking aperture configured to releaseably engage said locking post;

wherein the package is configured to permit said sliding tray to translate from a locked position to an unlocked position by urging the release button inwardly to disengage said locking aperture from said locking post.

2. The lockable package of claim 1, wherein the sliding tray further comprises a means for biasing an article contained within said compartment to facilitate removal of the article from the compartment.

3. The lockable package of claim 1, wherein the sliding tray further comprises a lever positioned to urge removal of an article contained within said compartment when an inward pushing force is applied to the lever.

4. The lockable package of claim 1, wherein the outer sleeve further comprises a release button stop configured to stop the inward movement of the release button.

5. The lockable package of claim 4, wherein the sliding tray further comprises a receiving notch configured to receive said release button stop.

6. The lockable package of claim 1, further comprising an article cover spanning said compartment and comprising a breachable gate cooperatively aligned with said access window to said compartment, wherein the breachable gate is configured to be lifted or torn from the article cover.

7. The lockable package of claim 6, wherein the breachable gate is constructed of paperboard.

8. The lockable package of claim 1, wherein the outer sleeve comprises a pair of locking posts and said locking tab of said sliding tray comprises a corresponding pair of locking apertures.

9. The lockable package of claim 1, wherein the outer sleeve further comprises guide rails configured to laterally direct movement of said sliding tray within the outer sleeve.

10. The lockable package of claim 1, wherein said sliding tray further comprises one or more engaging stops and the outer sleeve further comprises one or more engaging ribs corresponding to said engaging stops and positioned to contact said engaging stops to prevent said sliding tray from being fully extracted from the outer sleeve.

11. The lockable package of claim 1, wherein said compartment is defined by interior side walls within the sliding tray.

12. The lockable package of claim 1, wherein said sliding tray comprises a base and a top attached to the base, wherein said compartment is defined by side walls extending from the base and said access window is defined by an aperture in the top.

13. The lockable package of claim 1, wherein said sliding tray defines a plurality of compartments, each compartment configured to receive at least one article.

14. The lockable package of claim 1, wherein said sliding tray comprises a base including said compartment and a top spanning said compartment and attached to said base.

15. The lockable package of claim 1, wherein said outer sleeve comprises a first side matingly connected to a second side to form said interior void.

16. The lockable package of claim 1, further comprising at least one article contained within said compartment.

17. The lockable package of claim 16, wherein the article is a consumable product or a personal care product.

18. The lockable package of claim 16, wherein the article is selected from the group consisting of candy, food, vitamins, tobacco products, contact lens, birth control devices, smoking cessation patches, and hearing aid batteries.

19. The lockable package of claim 16, wherein said at least one article is in the form of a primary container containing a second article.

20. The lockable package of claim 19, wherein the primary container is selected from the group consisting of pouches, chips, satchels, pillows, vials, and blister packs.

21. A lockable package for storing and dispensing articles, comprising:

an outer sleeve having an interior void and an open end, wherein the outer sleeve comprises at least one locking post and a release button proximate to the locking post;

a sliding tray received within the interior void of the outer sleeve, the sliding tray defining at least one compartment having a floor and accessible through an access window and configured to receive at least one article, the sliding tray further comprising a locking tab having at least one locking aperture configured to releaseably engage said locking post, wherein the sliding tray further comprises a lever formed in the floor of the compartment and defined on at least one side by a slit in the floor of the compartment, the lever adapted to urge removal of an article contained within said compartment when an inward pushing force is applied to the lever;

wherein the package is configured to permit said sliding tray to translate from a locked position to an unlocked position by urging the release button inwardly to disengage said locking aperture from said locking post.

22. A lockable package for storing and dispensing articles, comprising:

an outer sleeve having an interior void, an open end, and a closed end, wherein the outer sleeve comprises at least one locking post and a release button proximate to the locking post, the locking post and the release button positioned proximal to the closed end of the outer sleeve;

a sliding tray having a first end and a second end, the first end received within the interior void of the outer sleeve and the second end having at least one relief positioned to abut the outer sleeve at the open end thereof when the package is in a locked position, the sliding tray comprising at least one compartment defined by a floor and side walls extending from the floor, the compartment being accessible through an access window and configured to receive at least one article, the sliding tray further comprising a locking tab positioned at the first end of the sliding tray and having at least one locking aperture configured to releaseably engage said locking post when the container is in the locked position with the relief of the sliding tray abutting the outer sleeve;

wherein the package is configured to permit said sliding tray to translate from the locked position to an unlocked position by urging the release button inwardly to disengage said locking aperture from said locking post.

* * * * *